US006155358A

United States Patent [19]

Brown

[11] Patent Number: 6,155,358

[45] Date of Patent: Dec. 5, 2000

[54] WIPER DEVICE FOR STRIPPING DRILLING FLUID FROM RIG DRILL STRING

[76] Inventor: William H. Brown, 406, 10903 - 21 Avenue, T6J 7A4 Edmonton, Canada

[21] Appl. No.: 09/177,418

[22] Filed: Oct. 22, 1998

[51] Int. Cl.[7] ..... E21B 41/00; A47L 25/00

[52] U.S. Cl. ..... 175/84; 166/82.1; 15/220.4

[58] Field of Search ..... 166/82.1, 83.1; 175/84, 209; 15/220.4, 256.6, 100, 88

[56] References Cited

U.S. PATENT DOCUMENTS

| | | | |
|---|---|---|---|
| 2,126,671 | 8/1938 | Slaugenhop | 166/82.1 |
| 2,655,679 | 10/1953 | Grant | 15/220.4 |
| 2,809,012 | 10/1957 | Stevens | 175/84 |
| 2,850,754 | 9/1958 | Davis | 15/220.4 |
| 3,475,781 | 11/1969 | Grant | 175/84 |
| 3,733,641 | 5/1973 | Brown | 15/220.4 |
| 4,457,366 | 7/1984 | Brown | 175/84 |
| 4,690,213 | 9/1987 | Stannard et al. | 166/83.1 |
| 4,982,787 | 1/1991 | Reddoch | 175/84 |
| 5,065,859 | 11/1991 | Brumby | 15/256.6 |
| 5,101,896 | 4/1992 | Thompson et al. | 166/82.1 |
| 5,842,252 | 12/1998 | Cameron et al. | 15/256.6 |

*Primary Examiner*—Brian L. Johnson
*Assistant Examiner*—Joselynn Z. Sliteris
*Attorney, Agent, or Firm*—Sheridan Ross P.C.

[57] ABSTRACT

The wiper device comprises an elongated conveyor arm which can pivot in a horizontal plane and freely move forward and backward through a limited travel (which movement capabilities are collectively termed "floating" capability). The arm carries a wiper pad assembly on its outer end. The wiper pad assembly can therefore float with the arm to accommodate lateral and to and fro sway of the drill string within the confines of the rig rotary table bushing, when the wiper pads are engaged with the drill string. The arm can be advanced and withdrawn to convey the wiper pad assembly between the operative stripping position over the bushing and a retracted position off to one side of the bushing.

13 Claims, 8 Drawing Sheets

WIPER DEVICE FOR STRIPPING DRILLING FLUID FROM RIG DRILL STRING

FIELD OF THE INVENTION

The present invention relates to a wiper device for stripping drilling fluid (such as drilling mud) from the exterior surface of a drill string being pulled out of a well.

BACKGROUND OF THE INVENTION

Wiper devices (commonly known as "strippers") have been used on drilling rigs for about 20 years to strip drilling fluid from drill pipe as it is being pulled or "tripped" out of the well. In one embodiment, the device comprises a pair of horizontal, opposed rubber wiper pads, each forming a semi-circular opening in the leading edge, which are simultaneously advanced to engage opposite sides of the circular drill pipe. The pads are vertically staggered in that one is above the other so that they overlap in encircling the pipe. Each wiper pad is sandwiched and bolted between steel plates along the back and side edges of the pad. The plate assembly is referred to herein as the holder. Pneumatic, double-acting cylinders connected to the holders move them between a stripping position, wherein the pads are pressed against the drill pipe, and a retracted or open position. The stripped mud is caught in an underlying catch basin and recycled to the rig mud system.

U.S. Pat. No. 3,133,641, issued to the present inventor, discloses such a stripper in which the wiper pad assemblies "float". The main problem addressed by this patent was how to design the wiper pad assemblies so they could cope with the tendency of the drill string to sway laterally in the course of being pulled through the wiper pads. The drill string sways as it is pulled upwardly by the block and tackle of the rig. When being pulled, the drill string travels up through the annular rotary drive bushing of the rig rotary table. The bushing opening will commonly have an inside diameter of 10⅝"—the drill pipe may have an outside diameter of 4½". So there is a clearance on each side of the centered drill string of about 3". As a result, the drill string is free to sway laterally a few inches before it contacts the bushing and is stopped. The drill string is very heavy and its lateral movement can only be resisted by very heavy and strong structure. This means that the cylinders actuating the wiper pad assemblies cannot be anchored to a non-yielding structure. Otherwise the unyielding cylinder and wiper pad could be damaged by the oncoming swaying drill string. The answer provided by the patent was to mount the cylinders so that they bridged and were connected to the two wiper pad assemblies. The cylinders thus rode or floated with the wiper pads and were unaffected by the pipe sway.

In U.S. Pat. No. 4,457,366, also issued to the present inventor, a different approach was taken to providing floating capability. In this case, the cylinder actuating the wiper pad assembly was connected at its outer end to a vertical pivot pin anchored to a stationary support. The pad assembly and cylinder could thus pivot in a horizontal plane to accommodate lateral movement of the drill string. The head ends of the two actuating cylinders were connected by a line to allow one cylinder to dump air into the other, to enable the first cylinder to retract while the second extended, thereby accommodating to and fro movement of the drill string.

The known strippers just described have always been limited to use with land-based rigs. The stripper would be mounted in the rig sub-structure, beneath the rotary table bushing. It would be a permanent in-line structure through which the drill string would extend during drilling and tripping.

There has been a long standing need for strippers on large off-shore rigs. However, due to the extensive blow-out preventer equipment used with off-shore rigs, there has usually not been room beneath the rotary table to accommodate the conventional in-line stripper.

It is the objective of the present invention to provide a stripper which is adapted to be mounted and used either on the rig floor or below it, while preserving the ability of the wiper pad assemblies to float w ith the drill string.

SUMMARY OF THE INVENTION

In one embodiment, a wiper device or stripper is provided having a wiper pad assembly mounted on the end of an elongated conveyor arm. The arm can be advanced to bring the wiper pad assembly to a stripping position over the bushing and withdrawn to assume a retracted position to one side of the bushing. The conveyor arm can pivot in a horizontal plane to accommodate lateral movement of the drill string. The arm also is operative to slide forward and backward through a limited travel to accommodate to and fro movement of the drill string. Otherwise stated then, the wiper pad assembly is mounted on a conveyor arm which conveys it between stripping and retracted positions and the wiper pad assembly is operative to float with the drill string as it sways within the limiting confines of the rotary table bushing.

A more specific description of one embodiment of the stripper, as adapted for use on the rig floor, will now be given. More particularly the stripper comprises:

- a pedestal, preferably rotatable about a substantially vertical axis and most preferably being vertically adjustable, which can be secured to the rig floor in spaced relation to one side of the rotary table bushing;
- a support member, preferably a rearwardly projecting, horizontal, elongated cantilever beam, mounted on and coupled to the pedestal so as to pivot with it or rotate on it, the support member having a horizontally extending support surface means. The support surface means preferably comprises a row of rollers carried by the support member;
- a conveyor arm, also preferably an elongated beam, which is coupled to the support member and supported by the support surface means so as to be able to slide easily along the support member toward and away from the bushing and to pivot or rotate in a horizontal plane together with the support member;
- a first means, preferably a first cylinder means, for biasing the conveyor arm back and forth along the support member between stripping and retracted positions;
- a wiper pad assembly, for stripping drilling fluid from the drill string. The wiper pad assembly is carried by the outer end of the conveyor arm. The assembly includes a pair of side opening and closing wiper pads. The wiper pads are pivotally mounted on the conveyor arm, for pivoting between a closed stripping position and an open disengaged position. The assembly further includes an actuating second cylinder means for opening and closing the wiper pads. The wiper pad assembly preferably operates on the principle of a common pair of ice tongs. More particularly, the preferred assembly comprises a pair of generally C-shaped wiper pad holders, each having a leg projecting from its base. The holder legs are pivotally mounted to an upstanding pivot pin mounted on the conveyor arm. The pin functions as a common pivot point for the two holders.

A linkage, corresponding with the handles of the tongs, connects the ends of the holder legs with the outer end of the second cylinder means. Expansion or contraction of the cylinder means causes the holders to open or close equally. The cylinder means preferably comprises an accumulator tank so that the pad holders can be spread apart by passage of a drill string enlargement without significant variance in cylinder pressure;

the wiper pad assembly, conveyor arm and first biasing means combining to form an interconnected first unit;

a connector means slidably connecting the inner end of the first cylinder means with the support member. When the cylinder means is extended to center the wiper pad assembly over the bushing, the sliding connector means enables the first unit to move with the drill string through sufficient travel, either forward or backwards, until the string contacts the bushing. The connector means preferably also includes elastic resilient means, such as a spring, for normally urging the first unit forwardly to assist it in following the drill string when it moves away from the pedestal.

In an alternative form designed for positioning beneath the rotary table, the pedestal can take the form of a stationary column of Teflon[1] on which the support member can turn.

[1] trade mark

Broadly stated, the invention is a wiper device for stripping drilling fluid from a drill string being pulled through the rotary table bushing of a drilling rig, comprising a wiper pad assembly comprising a pair of side opening and closing wiper pads for stripping drilling fluid from the drill string; means for carrying the wiper pad assembly between a retracted position spaced from the drill string and a stripping position where the wiper pads can close around the drill string; means for biasing the carrying means between retracted and stripping positions; the wiper pads being pivotally mounted on the carrying means for pivoting in a horizontal plane between a closed stripping position and an open disengaged position; means for actuating the wiper pads to open and close them; the carrying means being operative to pivot in a horizontal plane and to reciprocate to and fro, so that the wiper pads may float with the drill string when closed therearound in the stripping position, as the drill string sways within the limiting confines of the table bushing.

DESCRIPTION OF THE PREFERRED EMBODIMENT

Figure 1:
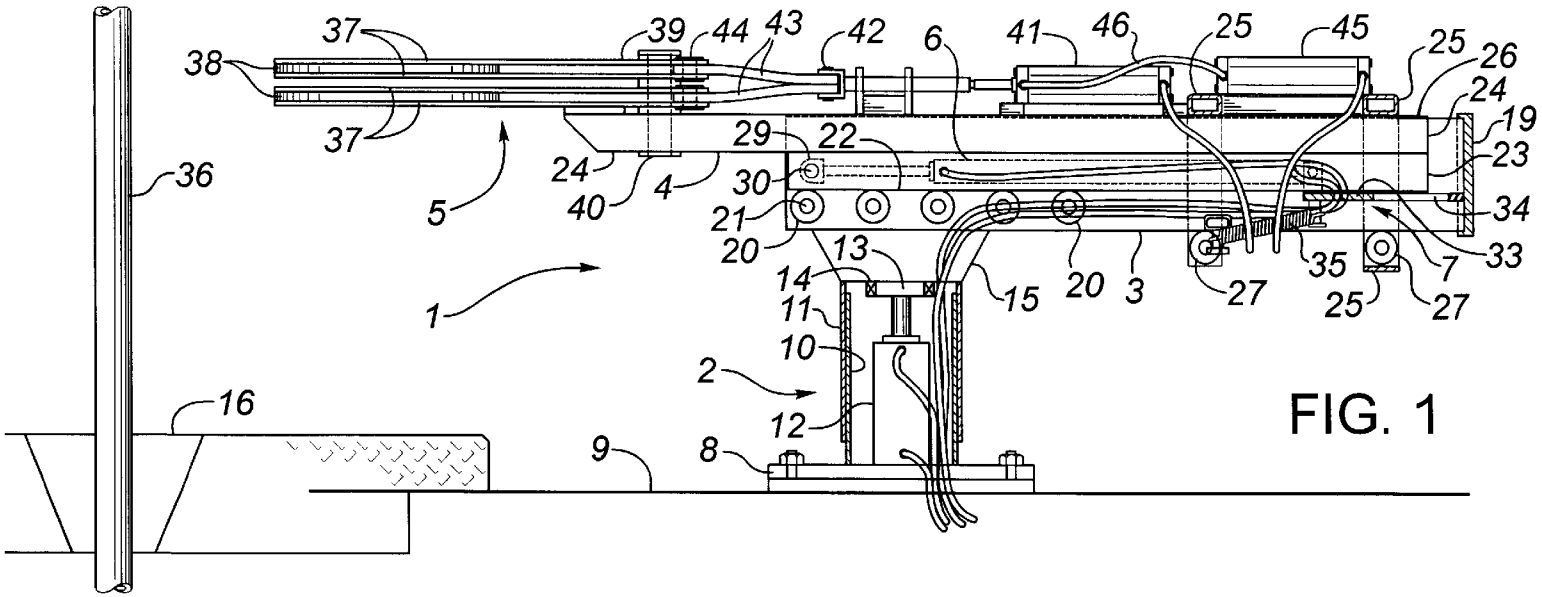
FIG. 1 is a side view of the stripper showing the drill string and the relative positioning of the stripper on the rig floor, with the stripper in the retracted position.

Having reference to the drawings, a stripper 1 is shown comprising a pedestal 2, a support member 3 secured to the upper end of the pedestal, a conveyor arm 4 slidably supported by the support member 3, a wiper pad assembly 5 carried by the outer end of the conveyor arm, a cylinder means 6 for biasing the conveyor arm to extend and retract it and a float plate assembly 7 for providing float capability to the unit comprising the wiper pad assembly, conveyor arm and biasing cylinder.

Figure 7:
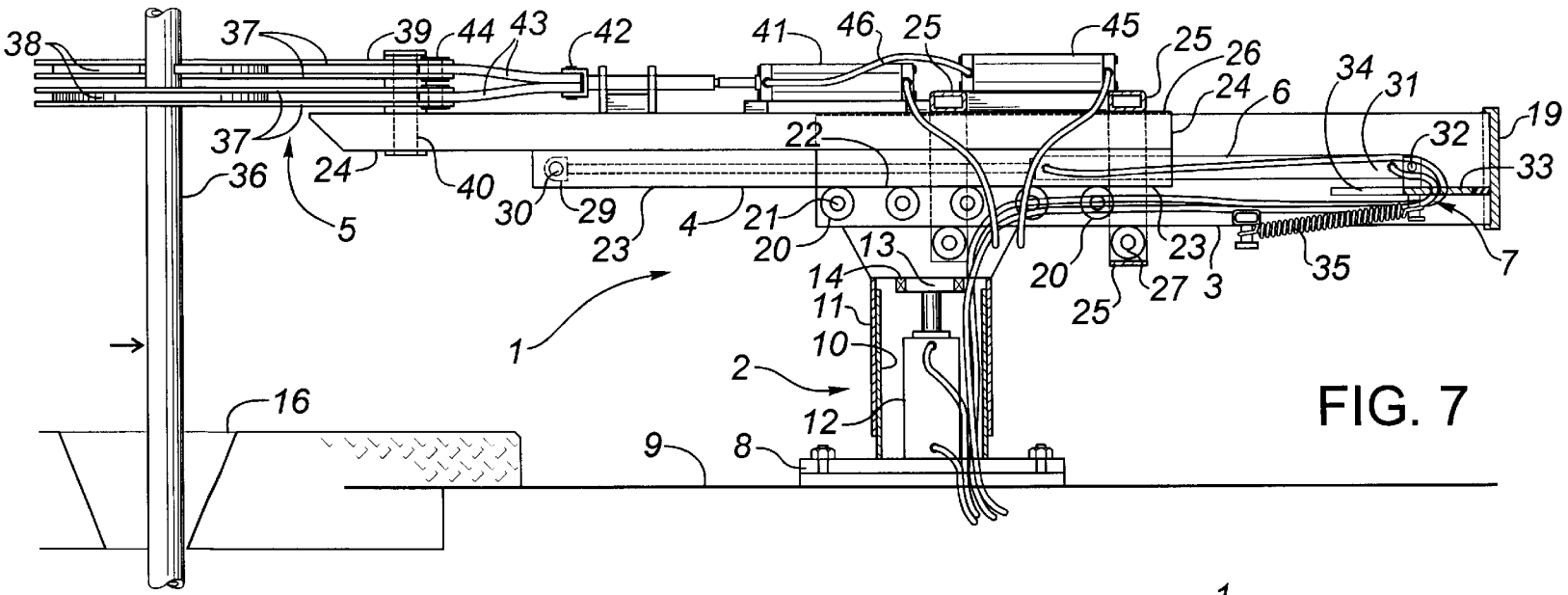
FIG. 7 is a side view of the stripper in the stripping position, showing the orientation of the components when the drill string sways.
Figure 8:
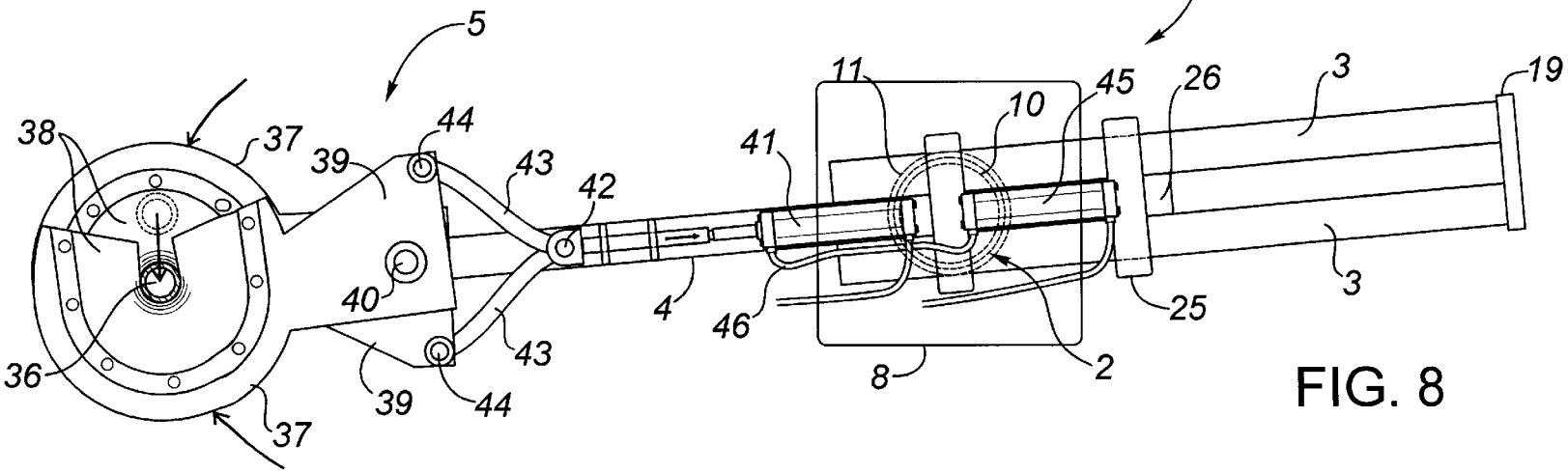
FIG. 8 is a top view of the stripper in the stripping position, showing the orientation of the components when the drill string sways in a lateral direction.
Figure 9:
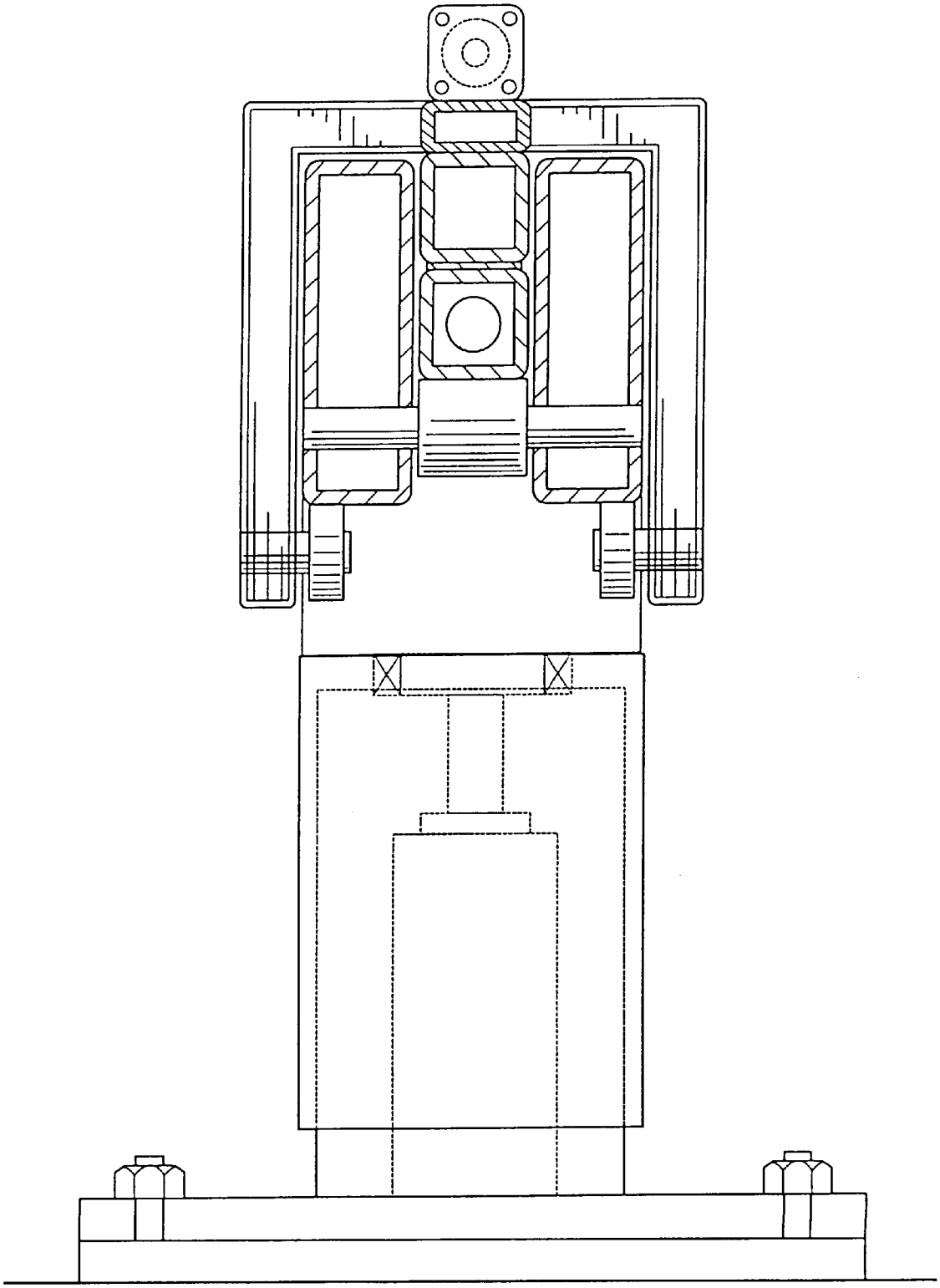
FIG. 9 is a longitudinal view from the rear of the stripper with the float end plate removed.

More particularly, the pedestal 2 comprises a mounting plate 8 bolted to the rig floor 9. A cylindrical inner tube 10 extends upwardly from and is welded to the mounting plate. A cylindrical outer tube 11 is concentrically mounted over the inner tube 10. A hydraulic lift cylinder 12 is vertically positioned within the inner tube 10 and is mounted on the mounting plate 8; its rod end 13 bears against a bronze bearing plate 14 secured to the inner surface of the end member 15 of the outer tube 11 (see FIG. 7). The outer tube 11 can therefore be raised and lowered as required and is free to rotate or turn on the rod end 13 about a vertical axis.

The pedestal 2 is positioned on the rig floor 9 to one side of the rotary table bushing 16.

The elongated, rearwardly projecting, horizontal, cantilevered support member 3 is welded to the pedestal end member 15. The support member 3 is generally U-shaped, having two parallel, spaced apart side walls 17 forming a longitudinally extending channel 18. The channel 18 is open at its forward or outer end and closed at its rear or inner end by a removable plate 19. A series of aligned rotatable horizontal rollers 20 are mounted on axles 21 journalled in the side walls 17. The rollers 20 form a horizontally extending support surface 22 on which the conveyor arm 4 may slide or roll along the support member 3. The channel 18 thus forms a slide path having a rear stop, along which the conveyor arm 4 may move to and fro.

Figure 10:
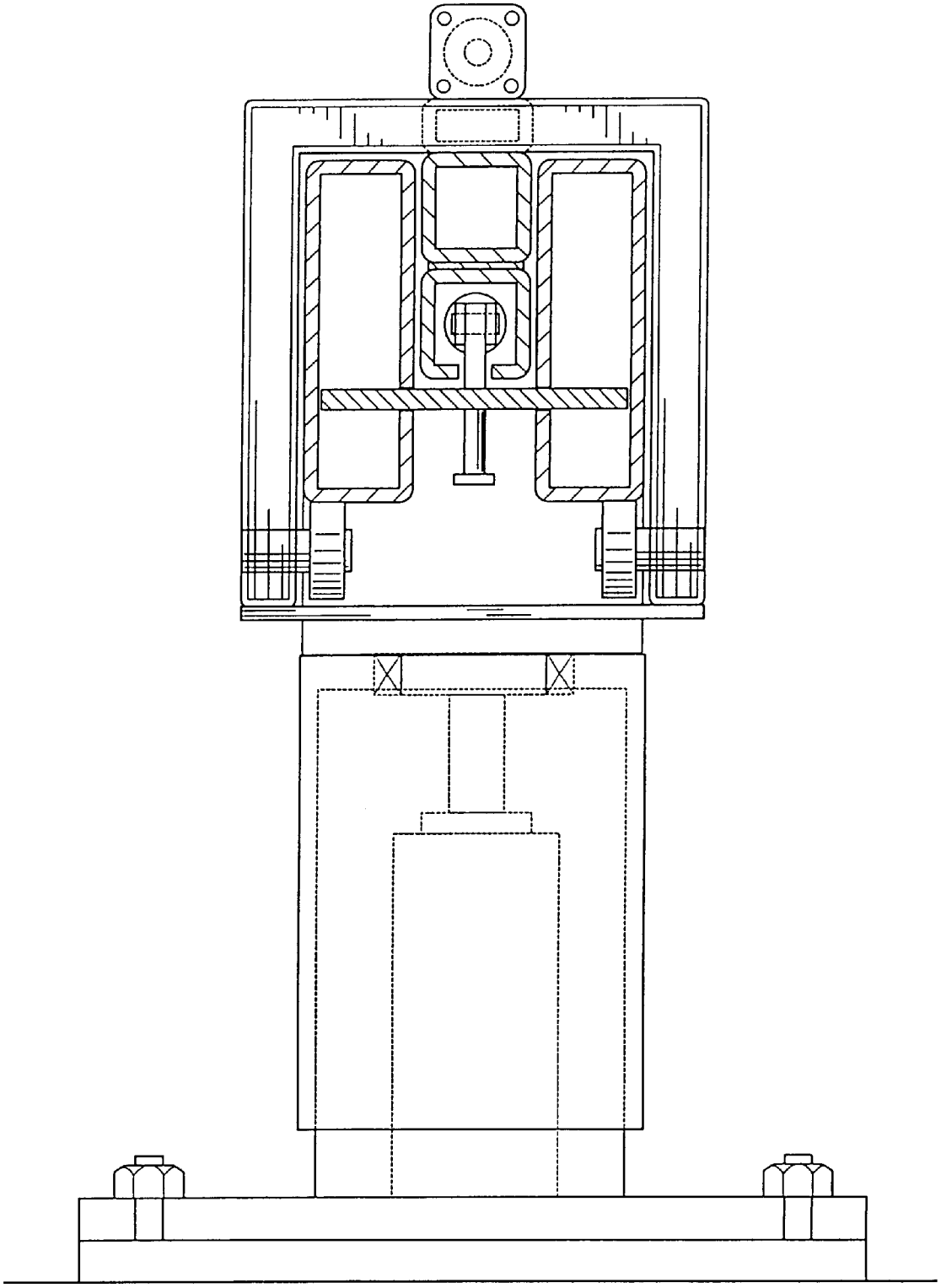
FIG. 10 is a longitudinal view from the rear of the stripper with the float plate present.
Figure 11:
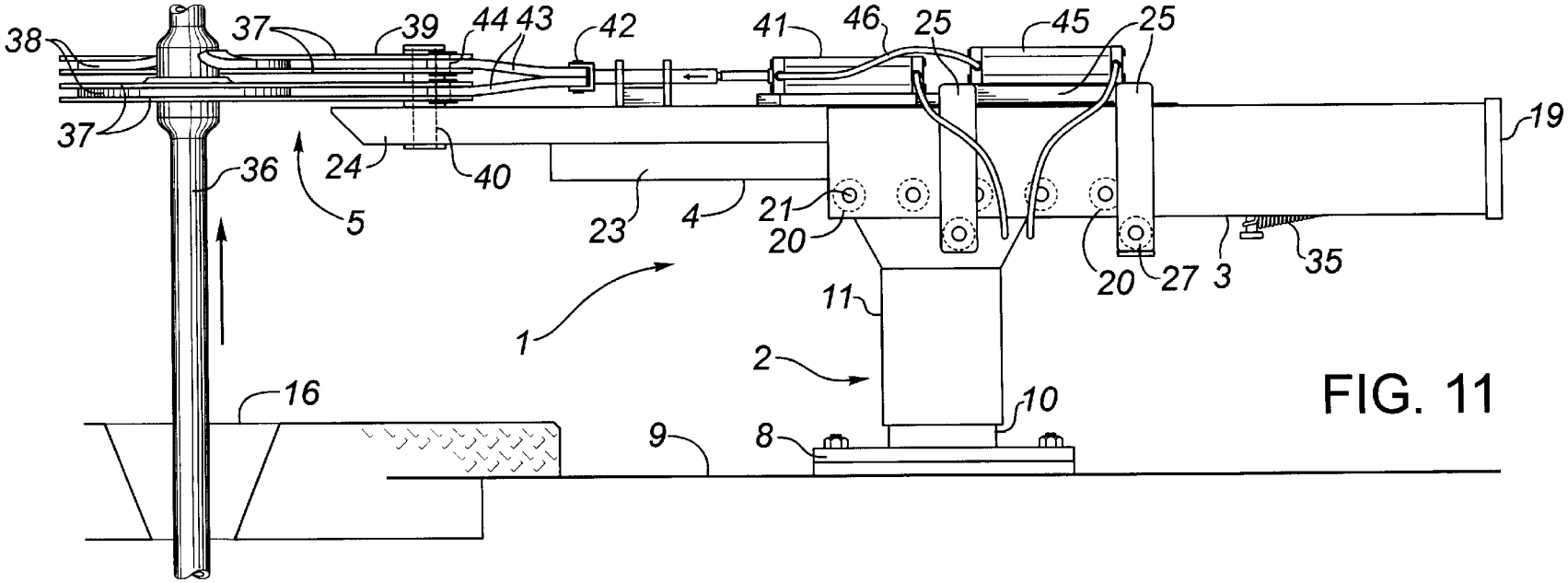
FIG. 11 is a side view of the stripper showing the orientation of the components when an enlargement is pulled between the wiper pads.
Figure 12:
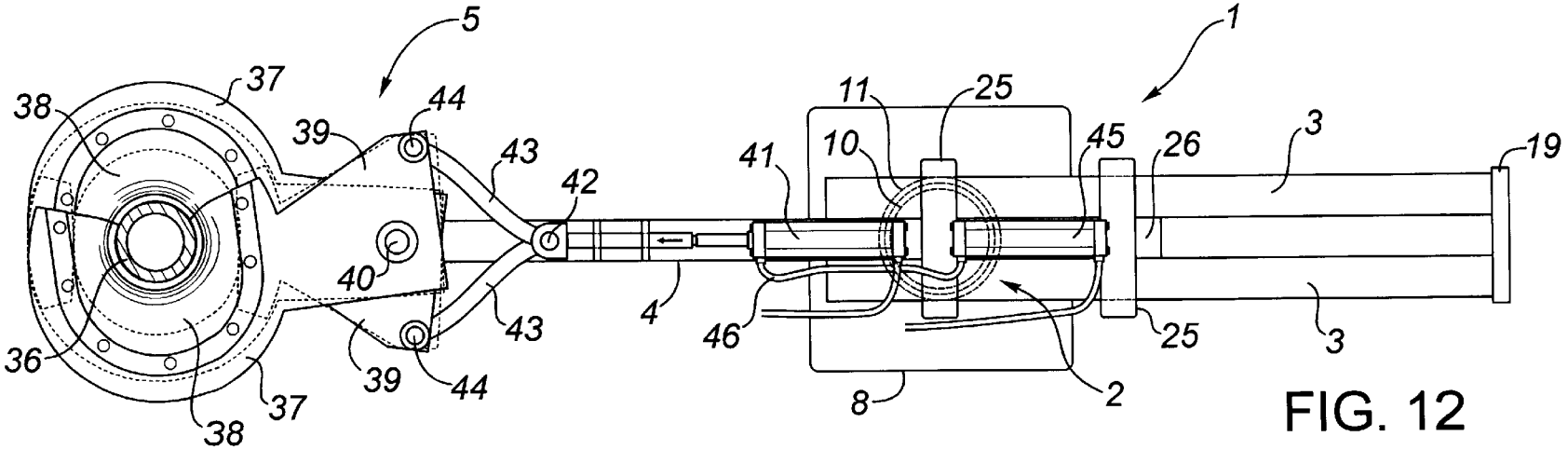
FIG. 12 is a top view of FIG. 11.

The elongated conveyor arm 4 is formed by two vertically stacked lengths of square tubing 23, 24 welded together. As previously indicated, the conveyor arm 4 is positioned in the channel 18 and is supported by the rollers 20. It can roll or slide easily along the rollers. A pair of U-shaped retainer frames 25 are welded to the top surface 26 of the conveyor arm 4. The frames 25 carry rollers 27 which engage the underside of the support member 3 (see FIG. 10). The frames and rollers secure the conveyor arm 4 to the support member 3.

From the foregoing, it will be noted that the support member 3 and conveyor arm 4 can turn together on the pedestal 2 and their elevation can be adjusted by the lift cylinder 12. The conveyor arm 4 can slide along the support member 3 between stripping and retracted positions.

Figure 2:
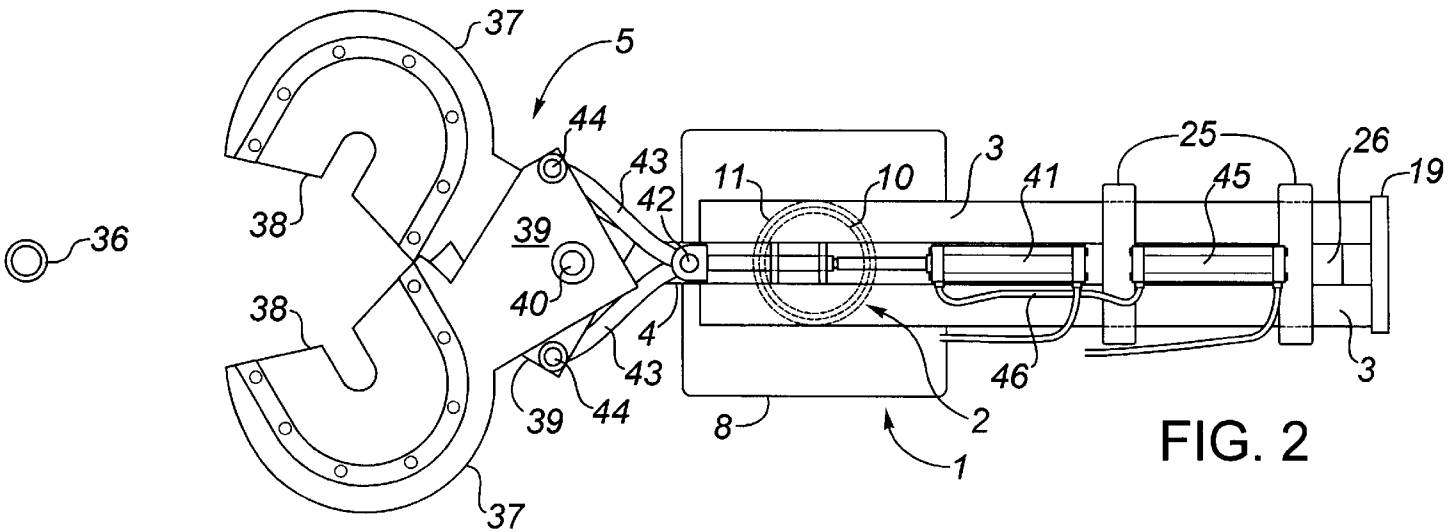
FIG. 2 is a top view of FIG. 1, with the side opening and closing wiper pads in the open disengaged position.
Figure 3:
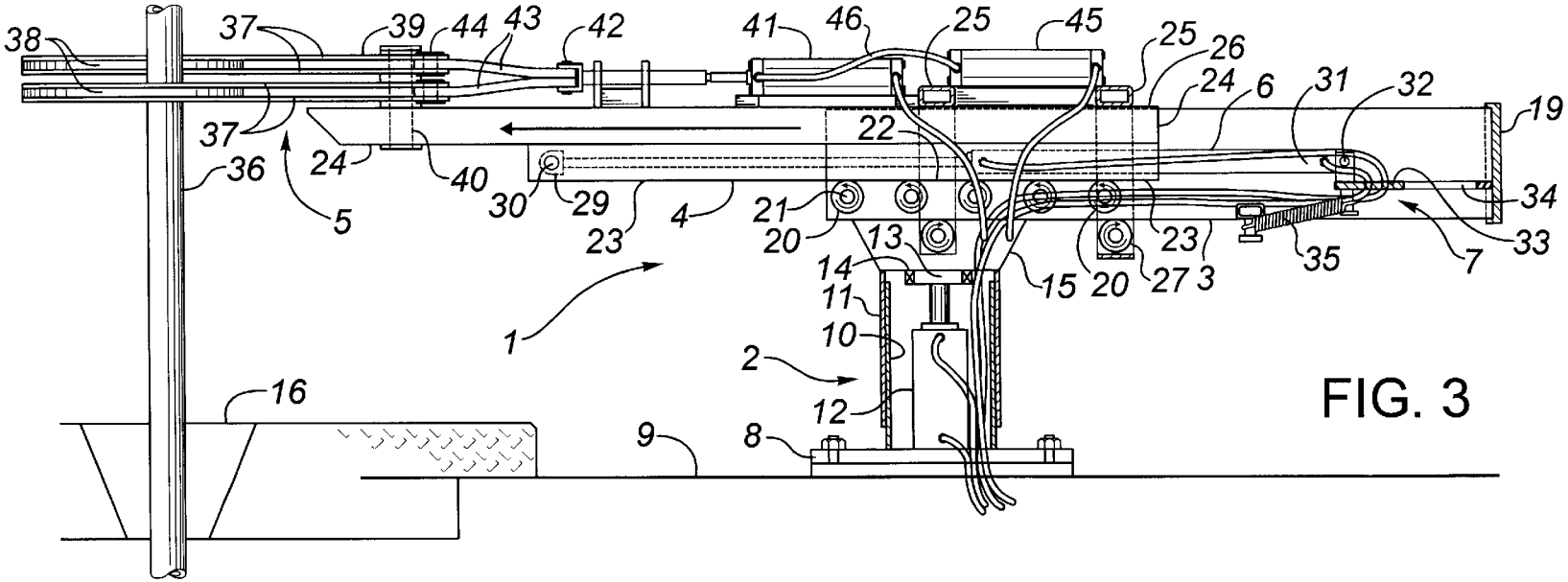
FIG. 3 is a side view of FIG. 1 showing the orientation of the stripper components when the wiper pad assembly is positioned in the extended stripping position, with the wiper pads open.
Figure 4:
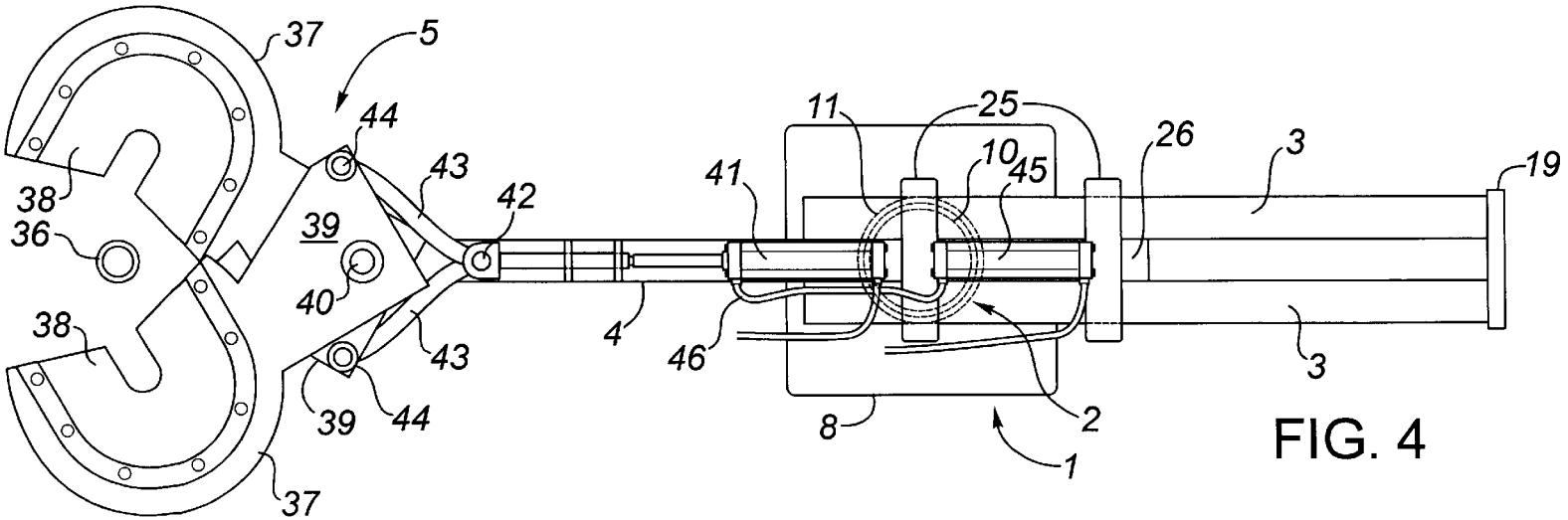
FIG. 4 is a top view of FIG. 3.

A pneumatic cylinder 6 is provided for biasing the conveyor arm 4 between the stripping position shown in FIGS. 3–6 and the retracted position shown in FIGS. 1–2. The biasing cylinder 6 is positioned within the bore 28 of the lower square tubing 23. The outer rod end 29 of the cylinder 6 is connected to the outer end of tubing 23 by a pin 30.

Figure 5:
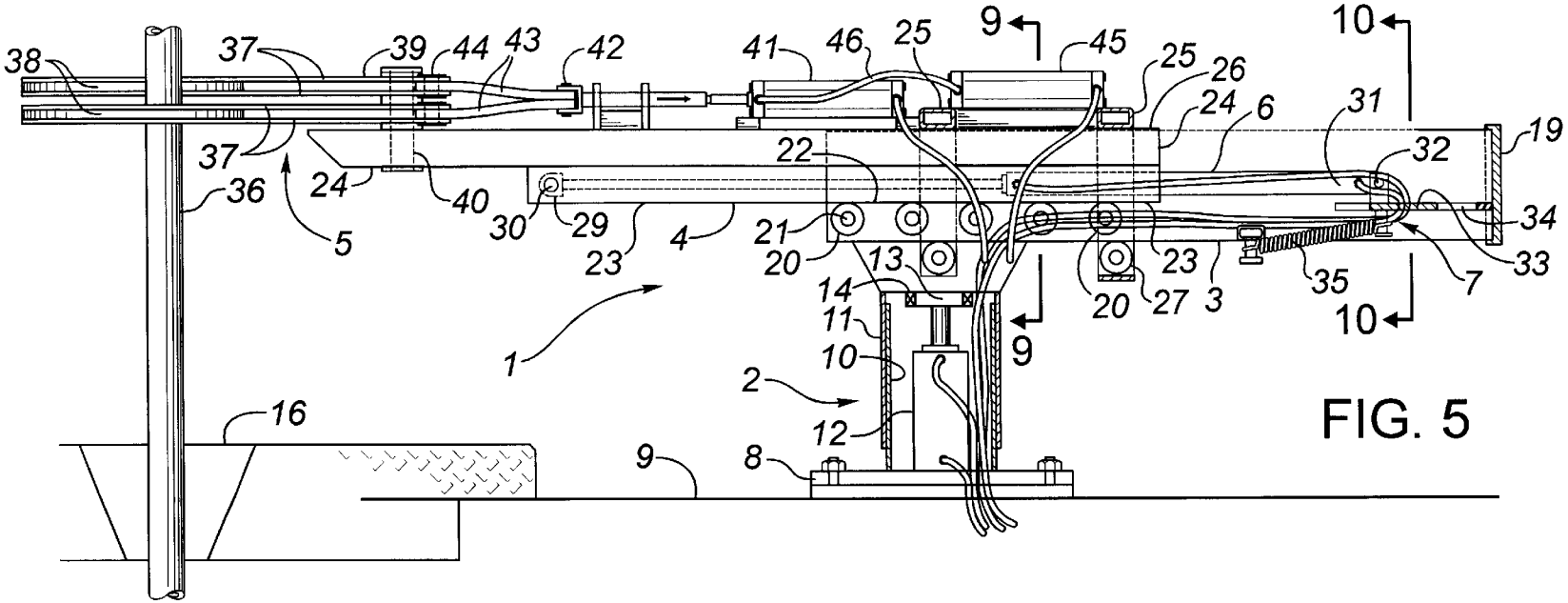
FIG. 5 is a side view of FIG. 3 showing the orientation of the stripper components when the wiper pad assembly is positioned in the stripping position with the wiper pads in the closed stripping position.
Figure 6:
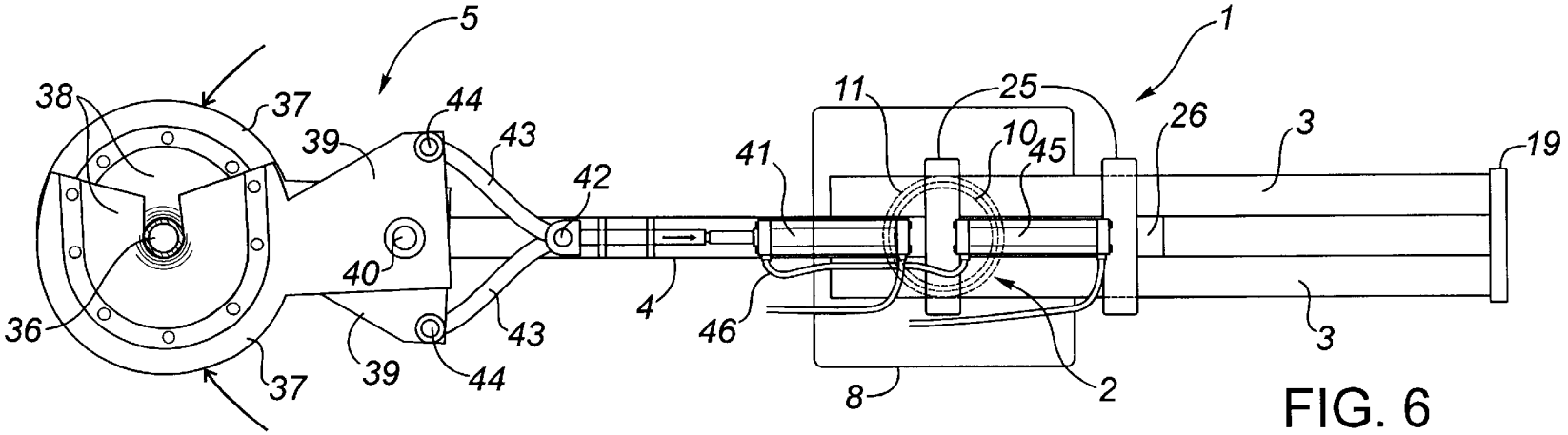
FIG. 6 is a top view of FIG. 5.
Figure 13:
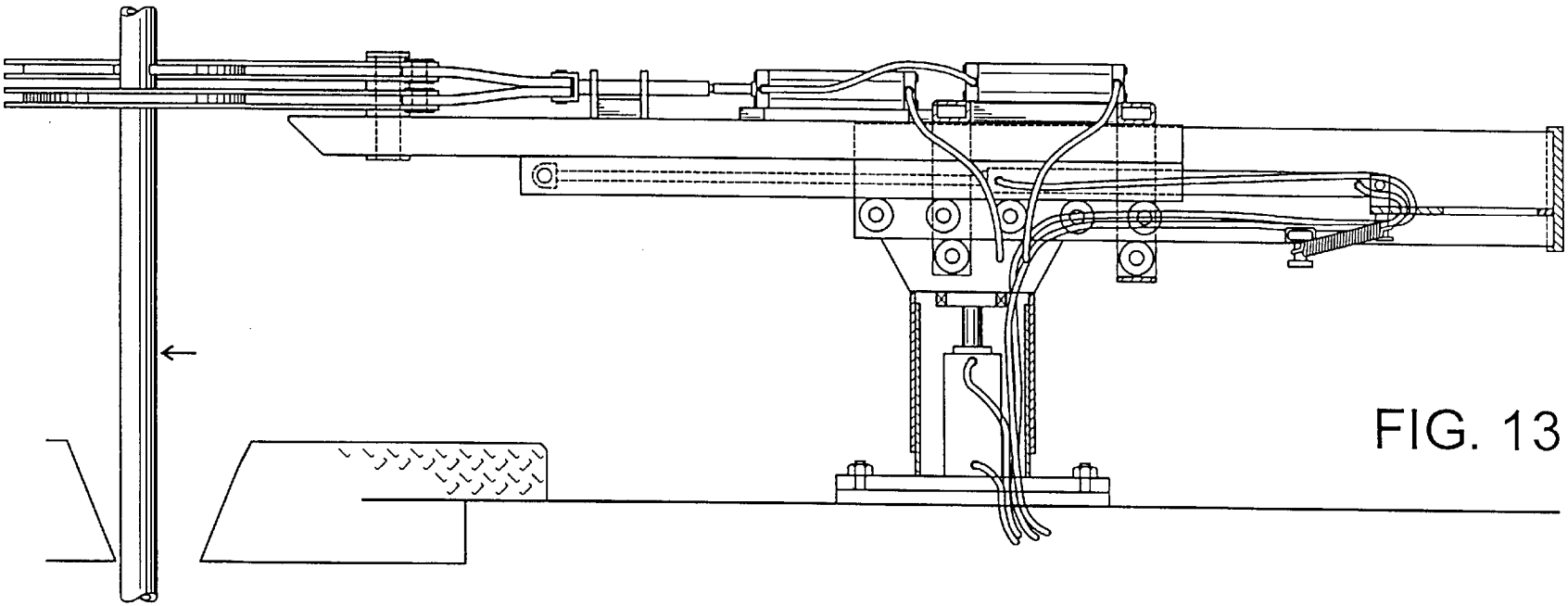
FIG. 13 is a side view of the stripper in the stripping position, showing the orientation of the compounds when the drill string sways outwardly.

The rear end 31 of the cylinder 6 is connected by a pin 32 to a float plate assembly 7 comprising a plate 33. The side walls 17 of the support member 3 are slotted along part of their length, starting from their rear ends, to form a slide track 34 for the float plate 33. A spring 35 connects the stationary support member 3 with the float plate pin 32 and functions to normally urge the float plate 33 forwardly. When the biasing cylinder 6 is fully extended, as shown in FIG. 5, the float plate 33 is centrally positioned along the slide track 34. There are about 4 inches of travel available to the plate 33, both forwardly and rearwardly, when the drill string is centered in the bushing. When the conveyor arm 4 is pulled forwardly by the drill string 36 swaying to the far side of the bushing 16, the float plate 33 advances and almost abuts the forward end of the slide track 34 (see FIG. 13). When the conveyor arm 4 is driven back by the drill string 36 swaying to the near side of the bushing 16, the float plate 33 slides back until it almost contacts the stop plate 19. In summary then, the pin 32, float plate 33 and slide track 34 combine to provide connector means slidably connecting the inner end of the biasing cylinder 6 with the support member 3 so that the cylinder 6 and the conveyor arm 4 are operative to move to and fro through a limited travel when the biasing cylinder 6 is fully extended to center the wiper pad assembly 5 over the bushing 16.

The wiper pad assembly 5 comprises a pair of vertically staggered, C-shaped wiper pad holders or "shoes" 37 which hold the rubber wiper pads 38. Each holder 37 has an extension or "leg" 39 protruding from its base end. The legs 39 pivotally engage an upstanding pin 40 connected with the forward end of the conveyor arm 4. A pneumatic actuating cylinder 41 is mounted on the conveyor arm 4 and its rod end is pivotally connected by a pivot pin 42 with a pair of links 43. The links 43 are in turn pivotally connected by pivot pins 44 with the legs 39. Extension of the actuating cylinder 41 causes the legs 39 and wiper pads 38 to open equally while contraction causes them to close equally about the drill string 36. An accumulator tank 45 is also mounted on the conveyor arm 4 and is connected by a line 46 with the actuating cylinder 41. The accumulator tank 45 allows enlargements in the drill string to spread the wiper pads without significant increase in the clamping pressure of the wiper pads.

In an alternative embodiment for use beneath the rig floor, one may remove the pedestal 2 and replace it with a short column on which the support member may readily turn. For example, the column could be made of Teflon.

In conclusion, the stripper 1 is based on the concept of mounting the wiper pad assembly 5 on the end of a conveyor arm 4 which can deliver the assembly 5 to a stripping position by rolling out on the support member 3. The wiper pads 38 are closed onto the drill string 36 by a linearly operating actuating system which is mounted on the conveyor arm 4. The float plate assembly 7 is provided to permit the rigid unit of wiper pad assembly 5, conveyor arm 4 and fully extended biasing cylinder 6 to slide back and forth sufficiently to accommodate the to and fro swaying of the drill string between the near and far edges of the rotary table bushing 16. The rotational capability of the pedestal 2 enables the support member 3 and conveyor arm 4 to pivot to accommodate lateral sway of the drill string.

Some changes may be made in the construction and arrangement of the stripper without departing from the real spirit and purpose of the invention, and it is my intention to cover by my claims any modified forms of structure or arrangement of mechanical equivalents which may be reasonably included within their scope.

The embodiments of the invention in which an exclusive property or privilege is claimed are defined as: follows:

1. A wiper device for stripping drilling fluid from a drill string being pulled through the rotary table bushing of a drilling rig comprising:

a support member having a horizontally extending support surface means;

a conveyor arm supported by the support surface means and coupled to the support member, said conveyor arm being operative to slide along the support surface means to move between stripping and retracted positions;

first biasing means for advancing and retracting the conveyor arm between the positions, the means being connected at its outer end to the conveyor arm;

a wiper pad assembly having side opening and closing wiper pads for stripping drilling fluid from the drill string, said wiper pads being pivotally mounted on the conveyor arm for pivoting between a closed stripping position and an open disengaged position said assembly being carried by the outer end of the conveyor arm;

the wiper pad assembly, first biasing means and conveyor arm forming a first unit;

connector means slidably connecting the inner end of the first biasing means with the support member so that, when the first biasing means is extended to center the wiper pads over the bushing, the sliding connector enables the first unit to move either forwards or backwards with the drill string until it contacts the bushing;

whereby the first unit may float with the drill string when the latter is swaying as it is being pulled through the bushing.

2. The wiper device as set forth in claim 1 wherein:

the support member is rotatable about a substantially vertical axis and the conveyor arm is coupled thereto so as to rotate therewith;

the support member forms a slide path having a rear stop, and the connector means comprises a plate, retained by the support member and positioned to slide back and forth along the slide path, the rearward travel of the plate being limited by the stop, and elastic resilient means for normally urging the plate and first unit forwardly.

3. The wiper device as set forth in claim 2, wherein the wiper pad assembly comprises:

a pair of overlapping wiper pad carriers carrying the wiper pads and being operative to pivot together or apart in a substantially horizontal plane about a common pivot point, a second cylinder means carried by the conveyor arm, linkage means connecting the second cylinder means with the wiper pad carriers, said linkage means being operative to open and close the carriers equally in response to the second cylinder means contracting and expanding; and an accumulator tank connected with the second cylinder means for allowing a drilling string enlargement to spread apart the wiper pads without significantly changing the fluid closing pressure.

4. The wiper device as set forth in claim 1 wherein:

the support member forms a generally horizontal, elongated support surface and the conveyor arm is an elongated beam positioned on the support surface.

5. The wiper device as set forth in claim 4 wherein:

the first biasing means is a double acting cylinder having one end connected to the conveyor arm and its other end connected to the connector means.

6. The wiper device as set forth in claim 5, wherein the wiper pad assembly comprises:

a pair of overlapping wiper pad carriers carrying wiper pads and being operative to pivot together or apart in a substantially horizontal plane about a common pivot point.

a second cylinder means carried by the conveyor arm, linkage means connecting the second cylinder means with the wiper pad carriers, said linkage means being operative to open and close the carriers equally in response to the second cylinder means contracting and expanding; and an accumulator tank connected with the second cylinder means for allowing a drilling string enlargement to spread apart the wiper pads without significantly changing the fluid closing pressure.

7. The wiper device as set forth in claim 1, wherein the wiper pad assembly comprises:

a pair of overlapping wiper pad carriers carrying the wiper pads and being operative to pivot together or apart in a substantially horizontal plane about a common pivot point, a second cylinder means carried by the conveyor arm, linkage means connecting the second cylinder means with the wiper pad carriers, said linkage means being operative to open and close the carriers equally in response to the second cylinder means contracting and expanding; and an accumulator tank connected with the second cylinder means for allowing a drilling string enlargement to spread apart the wiper pads without significantly changing the fluid closing pressure.

8. A wiper device for stripping drilling fluid from a drill string being pulled through the rotary table bushing of a drilling rig, comprising:

a wiper pad assembly comprising a pair of side opening and closing wiper pads for stripping drilling fluid from the drill string;

means for carrying the wiper pad assembly between a retracted position spaced from the drill string and a stripping position where the wiper pads can close around the drill string;

means for biasing the carrying means between retracted and stripping positions;

the wiper pads being pivotally mounted on the carrying means for pivoting in a horizontal plane between a closed stripping position and an open disengaged position;

means for actuating the wiper pads to open and close them;

the carrying means being operative to pivot in a horizontal plane and to reciprocate to and fro, so that the wiper pads may float with the drill string when closed therearound in the stripping position, as the drill string sways within the limiting confines of the table bushing.

9. The wiper device as set forth in claim 8 wherein the wiper pad assembly comprises:

a pair of overlapping wiper pad carriers carrying the wiper pads and being operative to pivot together or apart in a substantially horizontal plane about a common pivot point, a second cylinder means carried by a conveyor arm, linkage means connecting the second cylinder means with the wiper pad carriers, said linkage means being operative to open and close the carriers equally in response to the second cylinder means contracting and expanding; and an accumulator tank connected with the second cylinder means for allowing a drilling string enlargement to spread apart the wiper pads without significantly changing the fluid closing pressure.

10. The wiper device as set forth in claim 8 wherein:

the carrying means is a longitudinally movable conveyor arm; and the wiper pads are pivotally mounted on the conveyor arm for pivoting about a common pivot point between the disengaged and stripping positions.

11. The wiper device as set forth in claim 10, wherein the wiper pad assembly comprises:

a pair of overlapping wiper pad carriers carrying the wiper pads and being operative to pivot together or apart in a substantially horizontal plane about a common pivot point, a second cylinder means carried by the conveyor arm, linkage means connecting the second cylinder means with the wiper pad carriers, said linkage means being operative to open and close the carriers equally in response to the second cylinder means contracting and expanding; and an accumulator tank connected with the second cylinder means for allowing a drilling string enlargement to spread apart the wiper pads without significantly changing the fluid closing pressure.

12. The wiper device as set forth in claim 10 comprising:

a support member supporting the conveyor arm, the conveyor arm being longitudinally slidable to and fro on the support member;

a cylinder for biasing the conveyor arm to and fro, the cylinder being connected between the conveyor arm and the support member, the cylinder having a sliding connection with the support member; and spring means normally urging the conveyor arm to the extended position;

so that the sliding connection enables the conveyor arm to move either forward or backward with the drill string until the drill string contacts the bushing.

13. The wiper device as set forth in claim 12, wherein the wiper pad assembly comprises:

a pair of overlapping wiper pad carriers carrying the wiper pads and being operative to pivot together or apart in a substantially horizontal plane about a common pivot point, a second cylinder means carried by the conveyor arm, linkage means connecting the second cylinder means with the wiper pad carriers, said linkage means being operative to open and close the carriers equally in response to the second cylinder means contracting and expanding; and an accumulator tank connected with the second cylinder means for allowing a drilling string enlargement to spread apart the wiper pads without significantly changing the fluid closing pressure.

* * * * *